US005494020A

United States Patent [19]

Meng

[11] Patent Number: 5,494,020

[45] Date of Patent: Feb. 27, 1996

[54] APPARATUS FOR RECYCLING THE EXHAUST GAS OF AN ENGINE CRANKCASE

[76] Inventor: Frank Meng, 4F-2, No. 18, Ching Nien Rd., Taipei City, Taiwan

[21] Appl. No.: 344,859

[22] Filed: Nov. 25, 1994

[51] Int. Cl.[6] ..... F02M 25/06

[52] U.S. Cl. ..... 123/568; 123/572; 55/DIG. 19

[58] Field of Search ..... 123/572, 573, 123/570, 568; 55/DIG. 19

[56] References Cited

U.S. PATENT DOCUMENTS

| | | | |
|---|---|---|---|
| 3,877,451 | 4/1975 | Lipscomb | 123/573 |
| 4,082,071 | 4/1978 | Jones | 123/573 |
| 4,370,971 | 2/1983 | Bush | 123/573 |
| 4,409,950 | 10/1983 | Goldberg | 123/573 |

FOREIGN PATENT DOCUMENTS

| | | | |
|---|---|---|---|
| 2118861 | 11/1983 | United Kingdom | 123/573 |

*Primary Examiner*—David A. Okonsky

[57] ABSTRACT

An apparatus for recycling the exhaust gas of an engine crankcase, including an exhaust gas recycling unit having a filter element with a porous filter core supported on a spring inside a cylindrical shell, a mounting frame for mounting inside a car near the engine crankcase, a piston housing extended into the porous filter core at the center cylindrical shell and having a side hole and a bottom hole, a piston reciprocated in the piston housing to alternatively seal and open the side hole and bottom hole on the piston housing, an intake pipe for guiding exhaust gas from the engine crankcase into the exhaust gas recycling unit for filtration through the filter element and the porous filter core permitting filtrated gas to flow into piston housing through the side hole, and an outlet pipe for guiding filtrated gas out of the piston housing into the engine of the car.

2 Claims, 4 Drawing Sheets

APPARATUS FOR RECYCLING THE EXHAUST GAS OF AN ENGINE CRANKCASE

BACKGROUND OF THE INVENTION

The present invention relates to an apparatus for recycling the exhaust gas of the engine crankcase of a car which filtrates the exhaust gas of the engine crankcase permitting the filtrated gas to be further guided into the engine of the car for burning.

During the operation of the engine of a car, fuel mixture may partially leak out of the combustion chamber to the engine crankcase through the gap between the piston ring and the cylinder wall of the engine. Leaked fuel mixture mixed with exhaust gas of the engine crankcase must be properly treated otherwise it will pollute the air. Various economizers have been disclosed to collect the exhaust gas of the engine crankcase for recycling. The positive crankcase ventilating system (PCV system) is one of the most commonly used systems for recycling the exhaust gas of the engine crankcase. However, the PCV system cannot completely recycle the exhaust gas of the engine crankcase and partial exhaust gas will come out of the engine crankcase to pollute the air. Beside this Carbon will be precipitated on the inside wall of the engine crankcase when engine gas is retained in the hot engine crankcase, causing the air and oil holes of the engine blocked or partially blocked, and therefore the service life of the engine will be greatly shortened. Furthermore, when the speed of the car is reducing or the car is stopped while the engine is operating at a high speed, the throttle valve is closed, causing a high negative pressure produced at the intake manifold of the engine. Under this stage, the suction force of the high negative pressure will stop the valve of the PCV system, causing the cylinder of the engine unable to obtain sufficient air for combustion, and therefore carbon monoxide will instantly increase.

SUMMARY OF THE INVENTION

The present invention has been accomplished under the circumstances in view. It is therefore an object of the present invention to provide an apparatus for recycling, the exhaust gas of the engine crankcase which automatically filtrates the exhaust gas of the engine crankcase for recycling so as to prevent the engine crankcase from sending exhaust gas into the air. It is another object of the present invention to provide an apparatus for recycling the exhaust gas of the engine crankcase which controls the ratio of fuel mixture stable during the accelerating of the car. It is still another object of the present invention to provide an apparatus for recycling the exhaust gas of the engine crankcase which removes non-combustible solid matter from the exhaust gas of the engine crankcase permitting the filtrated gas to be guided back into the intake manifold of the engine for a complete combustion. It is still another object of the present invention to provide an apparatus for recycling the exhaust gas of the engine crankcase which completely filtrates the inflammable gas from the engine crankcase for combustion. It is still another object of the present invention to provide an apparatus for recycling the exhaust gas of the engine crankcase which eliminates the precipitation of carbon in the engine crankcase so as to improve the performance of the engine and save the consumption of fuel gas. It is still another object of the present invention to provide an apparatus for recycling the exhaust gas of the engine crankcase which is simple in structure and easy to manufacture.

DETAILED DESCRIPTION OF THE PREFERRED EMBODIMENT

Figure 1:
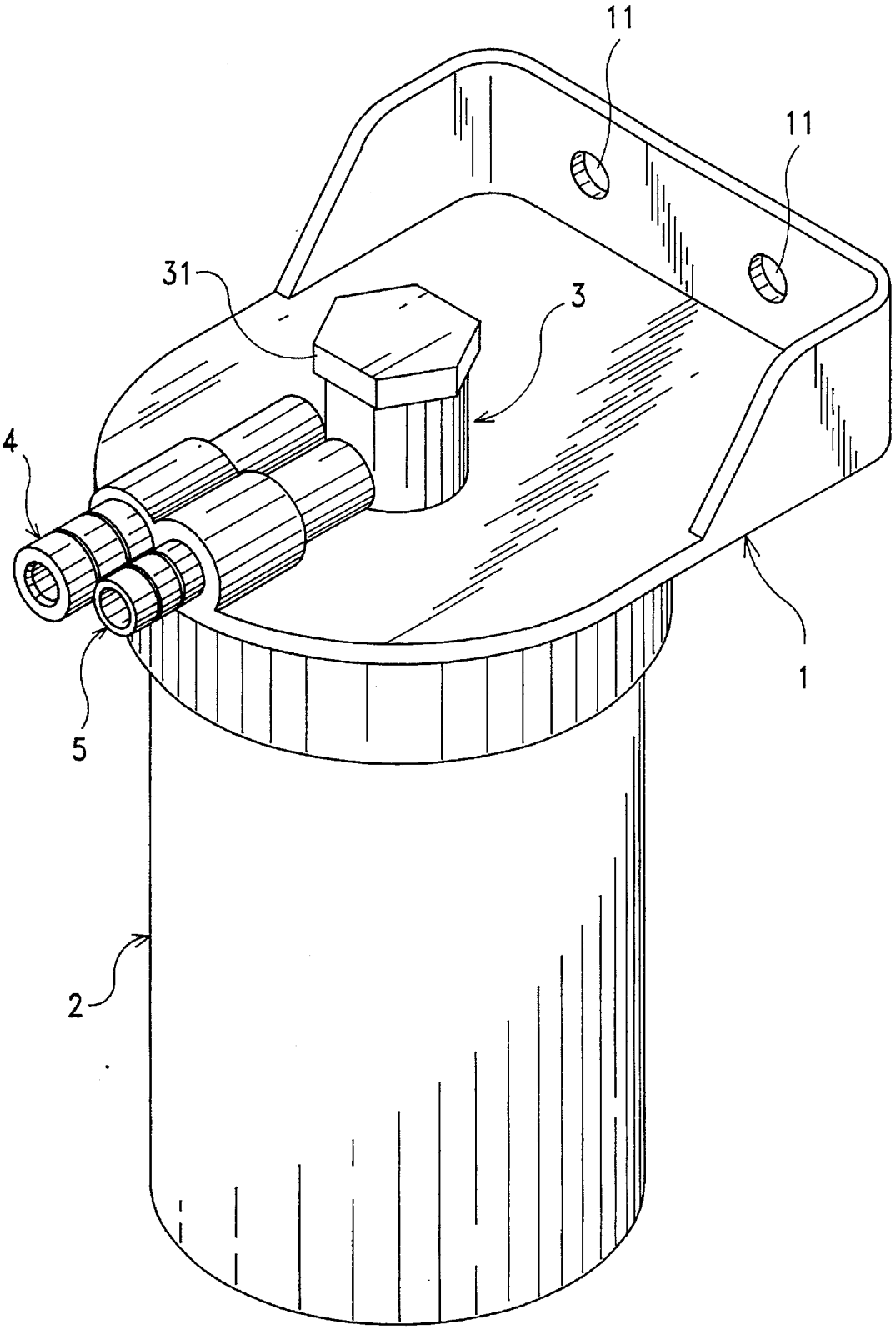
FIG. 1 is an elevational view of the apparatus of the present invention.
Figure 2:
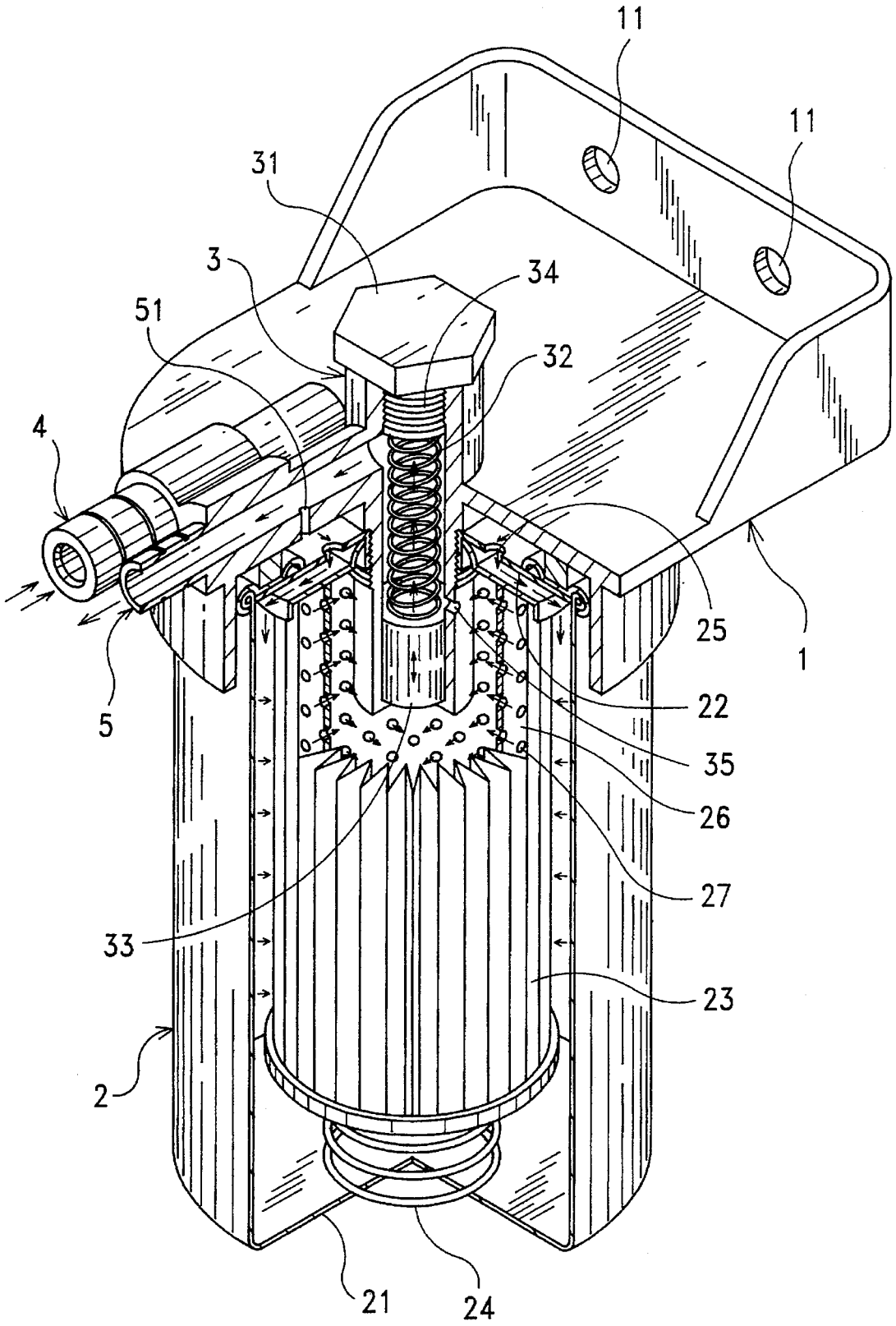
FIG. 2 is a section view of the apparatus shown in FIG. 1.

Referring to FIGS. 1 and 2, the present invention is generally comprised of a mounting frame 1, an exhaust gas recycling unit 2, a piston housing 3, an intake pipe 4, and an outlet pipe 5.

The exhaust gas recycling unit 2 comprises a cylindrical shell 21, a top cap 22, a filter element 23, and a spring 24. The top cap 22 covers on the cylindrical shell 21 at the top, having a plurality of intake holes 25. The filter element 23 is made from filter paper disposed inside the cylindrical shell 21 around a cylindrical filter core 26. The cylindrical filter core 26 is a perforated filter device supported on the spring 24, having a plurality of filtration holes 27.

The mounting frame 1 is affixed to the exhaust gas recycling unit 2 at the top, having a plurality of mounting holes 11 for fastening to the car near the engine by screws.

Figure 3:
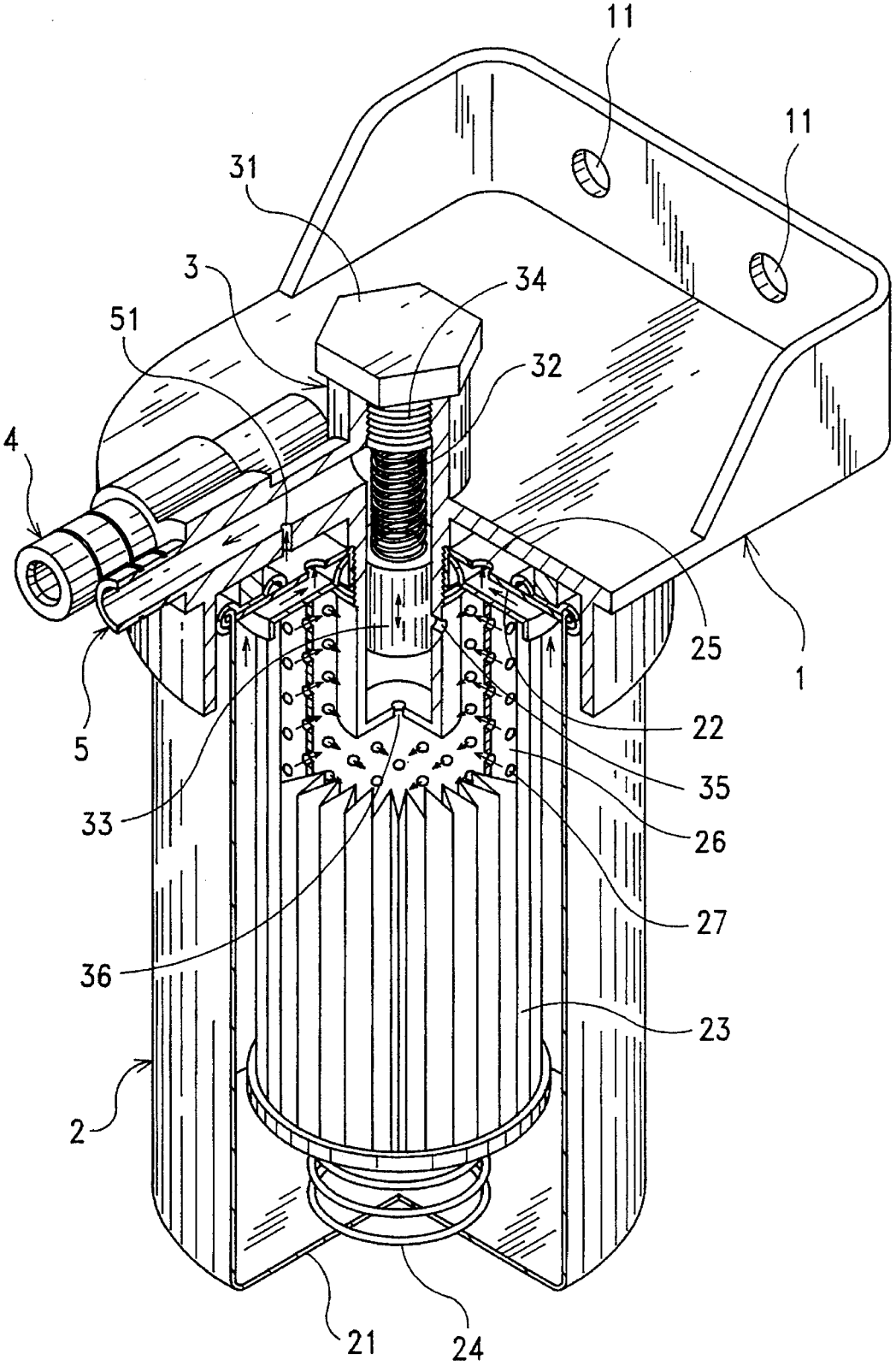
FIG. 3 is similar to FIG. 2 but showing the piston moved away from the bottom hole of the piston housing.
Figure 4A:
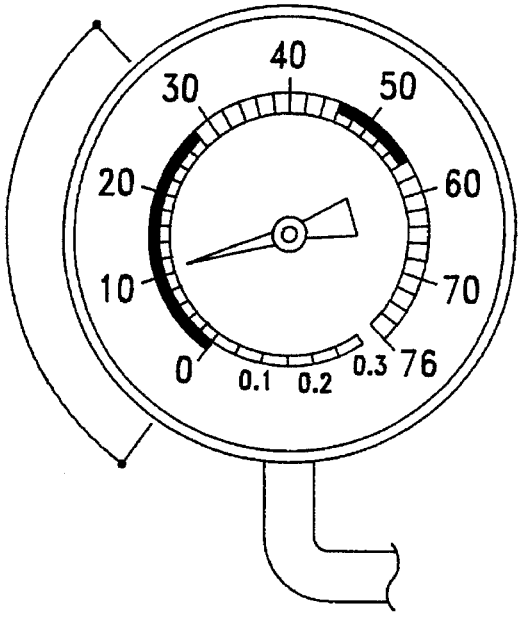
FIG. 4A is a plain view of a vacuum gage showing the negative pressure of the engine reduced during the accelerating of the car.
Figure 4B:
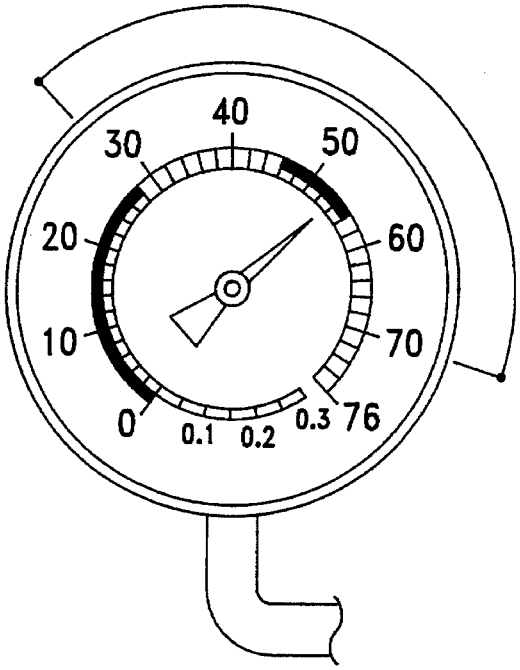
FIG. 4B is similar to FIG. 4A but showing the negative pressure of the engine increased during the brake speed reducing mode.

The piston housing 3 is made of cylindrical shape disposed at the center of the exhaust gas recycling unit 2 and inserted into the cylindrical filter core 26 of the filter element 23. The top end of the piston housing 3 extends out of the mounting frame 1 through a hole (not shown) thereof. A locating bolt 31 is disposed at the top of the piston housing 3. The locating bolt 31 has an externally threaded bolt body 34 threaded into an inner thread (not shown) on the piston housing 3 at the top. A piston 33 is disposed inside the piston housing 3. A compression spring 32 is disposed inside the piston housing 3 and stopped between the piston 33 and the externally threaded bolt body 34. The piston housing 3 has a side hole 35 disposed within the cylindrical filter core 26 of the filter 23, and a bottom hole 36 (see FIG. 3) disposed at the center of the bottom thereof. When the car is accelerating, i.e., when the vacuum gage indicates the negative pressure within 0 to 28 units as shown in FIG. 4A, the piston 33 is lowered to stop the bottom hole 36, causing the side hole 35 to be opened.

The intake pipe 4 is mounted on the mounting frame 1 at the top, having one end connected to the shell 21 of the exhaust gas recycling unit 2 and an opposite end for coupling exhaust port of the engine crankcase. The outlet pipe 5 is mounted on the mounting frame 1 at the top, having one end connected to the piston housing 3 and an opposite end for coupling to the intake manifold of the engine. The outlet pipe 5 has an air passage 51 communicated with the internal space of the exhaust gas recycling unit 2. This air passage 51 allows air to be sucked into the engine during its high speed operation when the car is reducing the speed or the brake is pressed.

Referring to FIGS. 2, 3, 4A and 4B, when the car is accelerating and the vacuum gage shows the negative pressure within 0 to 28 units, exhaust gas from the engine crankcase passes through the intake pipe 4 into the exhaust gas recycling unit 2, then flows through the intake holes 25 on the top cap 22 into the space between the shell 21 of the exhaust gas recycling unit 2 and the filter element 23, and then flows through the filter element 23 into the cylindrical filter core 26 and then into the space inside the piston housing 3 above the piston 33 via the side hole on the piston housing, and therefore the well filtrated inflammable gas is guided from space inside the piston housing 3 above the piston 33 into the intake manifold of the engine through the outlet pipe 5. When the engine is operated at a low speed and the vacuum gage indicates the negative pressure within 28 to 70 units, the well filtrated inflammable gas is approximately completely expelled out of the piston housing 3 into the engine, and at the same time, the piston 33 is moved upwards to seal the side hole 35 permitting the exhaust gas of the engine crankcase to be guided into the exhaust gas recycling unit 2 again for recycling.

What is claimed is:

1. An apparatus for recycling the exhaust gas of an engine crankcase, comprising:

an exhaust gas recycling unit comprising a cylindrical shell, a top cap disposed at the top of said cylindrical shell having a plurality of intake holes thereon;

a mounting frame affixed to the top of said exhaust gas recycling unit over said top cap and having a plurality of mounting holes for mounting within a motor vehicle near the engine crankcase;

a piston housing made of cylindrical shape, having a bottom end disposed within said exhaust gas recycling unit at the center and a top end extended out of said mounting frame through a hole thereon, said piston housing having a side hole in the middle, and a bottom hole at the bottom;

a piston reciprocated in said piston housing to alternatively seal and open said side hole and said bottom hole;

an intake pipe for guiding exhaust gas from said engine crankcase into said exhaust gas recycling unit through said intake holes on said top cap and flowing into said piston housing through said side hole;

an outlet pipe connected to the top of said piston housing for guiding filtrated gas out of said piston housing into the engine of the car, said outlet pipe having an air passage communicated with the inside space of said cylindrical shell of said exhaust gas recycling unit.

2. The apparatus of claim 1 wherein said piston housing comprises a locating bolt threaded into a stop screw hole thereof, and a spring stopped between said locating bolt and said piston.

* * * * *